United States Patent [19]

Pizzurro

[11] Patent Number: 4,515,082

[45] Date of Patent: May 7, 1985

[54] GUIDED PROJECTILE LENS COVER

[75] Inventor: Vito F. Pizzurro, Villa Park, Calif.

[73] Assignee: Ford Aerospace & Communications Corporation, Detroit, Mich.

[21] Appl. No.: 534,852

[22] Filed: Sep. 22, 1983

[51] Int. Cl.[3] ..... F42B 13/16

[52] U.S. Cl. ..... 102/293; 102/501; 102/520; 102/532

[58] Field of Search ..... 102/520–523, 102/532, 501, 293; 244/3.11, 3.13, 3.16

[56] References Cited

U.S. PATENT DOCUMENTS

| | | | |
|---|---|---|---|
| 1,710,109 | 4/1929 | Paulus et al. | 350/587 |
| 2,655,106 | 10/1953 | O'Brien | 102/70 |
| 3,336,872 | 8/1967 | Langen et al. | 102/70.2 |
| 3,426,433 | 2/1969 | Anderson | 33/50 |
| 3,431,815 | 3/1969 | Kaufmann, Jr. | 102/522 |
| 3,674,227 | 7/1972 | Jacobson | 102/293 |
| 3,747,530 | 7/1973 | Tepper | 102/70.2 P |
| 3,814,019 | 6/1974 | Hines, Jr. | 102/91 |
| 3,831,285 | 8/1974 | Vissing | 33/244 |
| 3,962,972 | 6/1976 | Skagerlund | 102/213 |
| 4,239,006 | 12/1980 | Kelson | 102/522 |

*Primary Examiner*—Harold J. Tudor

*Attorney, Agent, or Firm*—Edward J. Radlo; Robert D. Sanborn

[57] ABSTRACT

A cover (1) for protecting the surface (23) of a lens (3) disposed at the rear surface (21) of a guided projectile (7) is fabricated of Teflon or other soft material. Lens (3) faces rearward to receive guidance signals used to keep projectile (7) on a chosen path. Cover (1) protects lens surface (23) from combustive gases and particulates generated during projectile (7) firing, but must be removed shortly after firing to permit lens (3) to receive its guidance signals. Cover (1) comprises at least one vacated chamber (15) for receiving, via holes (17), high pressure combustive gases during firing. Subsequent to firing, the greater pressure within chamber (15) compared with the pressure surrounding cover (1) produces a net force of removal between cover (1) and projectile (7), causing cover (1) to be removed therefrom as desired.

4 Claims, 2 Drawing Figures

GUIDED PROJECTILE LENS COVER

DESCRIPTION

1. Technical Field

This invention pertains to the field of protecting rearward looking lenses of guided projectiles during firing of the projectiles (i.e., in the "breech environment").

2. Background Art

U.S. Pat. No. 3,814,019 discloses a protective cap for ordnance fuzes. Unlike the lens cover of the present invention, the cap is (1) used at the nose of the projectile, not at its rear; (2) not used in the breech environment; and (3) removed by flow-by gas, not by gas pressure differentials.

U.S. Pat. No. 3,747,530 shows a window protector on the nose, not the rear, of a projectile. The protector is removed by aerodynamic heating, not by gas pressure differentials as in the present invention.

U.S. Pat. No. 3,336,872 discloses a metal shield for protecting the fuze window of a projectile or missile. The shield is removed by aerodynamic heating, not by gas pressure differentials. Furthermore, the shield is made of metal, which is hazardous when the launch vehicle is an aircraft, because the shield could be ingested by the aircraft's engines.

U.S. Pat. No. 2,655,106 shows an ice guard for the nose of a projectile or missile; it is not suitable for the breech environment.

Secondary references are U.S. Pat. Nos. 1,710,109; 3,426,433; and 3,831,285.

None of the above prior art, alone or in combination, discloses the novel features of the present invention, in which a soft lens cover 1, safe for use in a jet aircraft application, protects the rearward-looking lens 3 of a guided projectile 7 in the breech environment, wherein the cover 1 contains at least one vacated chamber 15 for receiving gases of combustion as the projectile 7 is fired from its barrel, and gas pressure differentials cause the cover 1 to leave the rear surface 21 of the projectile 7 subsequent to the projectile 7 leaving its barrel.

DISCLOSURE OF INVENTION

The present invention is a soft cover (1) fabricated of Teflon or other suitable material for protecting a rearward-looking lens (3) in a projectile (7) from high pressure and particulates generated during the firing of the projectile (7).

The cover (1) comprises at least one vacated chamber (15) for receiving high pressure gases of combustion during the firing of the projectile (7). Soon after the projectile (7) leaves its barrel, the pressure within the chamber (15) becomes much greater than the pressure surrounding the rear surface of the cover (1). This gas pressure differential produces a net force of removal orthogonal to the rear surface (21) of the projectile (7), causing the cover (1) to leave the projectile (7), allowing lens (3) to have an unobstructed view of its guidance beam as desired.

Since the cover (1) is fabricated of a soft material, it can be safely ingested by a jet engine and thus safely used when the guided projectile (7) is launched from an aircraft.

BRIEF DESCRIPTION OF THE DRAWINGS

These and other more detailed and specific objects and features of the present invention are more fully disclosed in the following specification, reference being had to the accompanying drawings, in which.

DETAILED DESCRIPTION OF THE PREFERRED EMBODIMENTS

Figure 1:
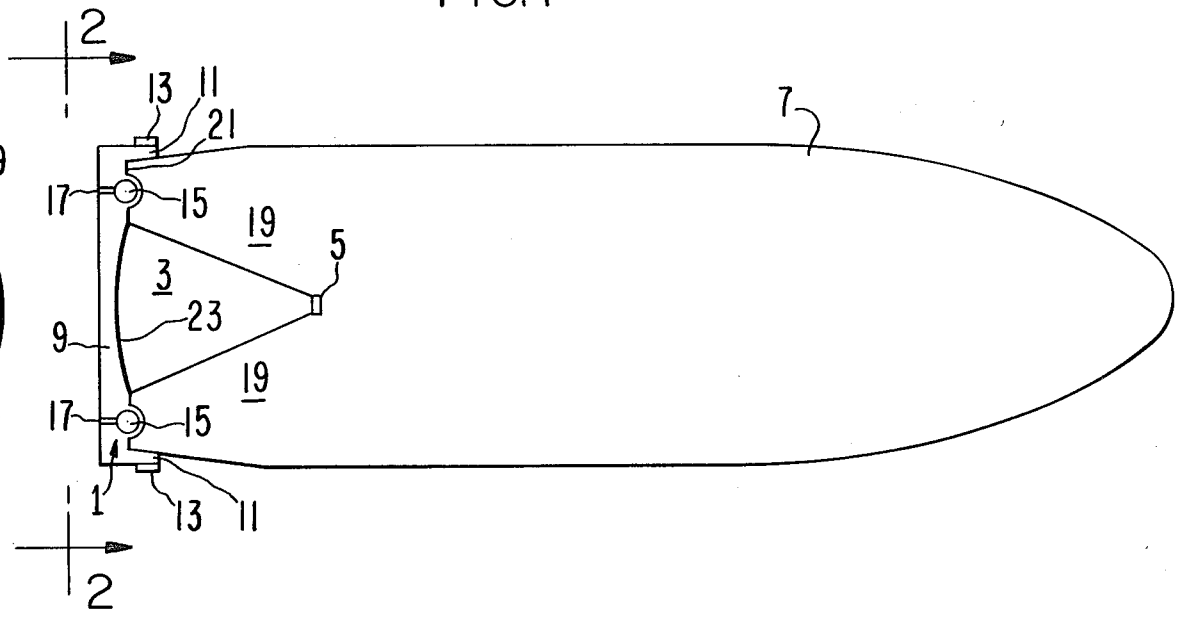
FIG. 1 is a cross-sectional side sketch of a guided projectile 7 in which lens cover 1 of the present invention is attached.

FIG. 1 shows a sketch of guided projectile 7 disposed for motion from left to right. Mounted in a rear section of projectile 7 is lens 3, which has a surface 23 that is part of the rear surface 21 of projectile 7. Lens 3 is thus disposed to receive radiation from a guidance beam, such as a laser beam, which may be mounted on the device, e.g., a jet aircraft, which launches projectile 7. Alternatively, the guidance beam may emanate from the ground or from another device. Such a system is commonly referred to as a "beam rider" guided projectile system. The frequency of operation can be at an optical or other electromagnetic frequency.

Lens 3 is fabricated of zinc selenide, silicon, glass, or some other suitable material. At the focal point of lens 3 is detector 5, which is responsive to the particular frequency of radiation employed. Detector 5 is attached directly to lens 3 in the embodiment illustrated, i.e., lens 3 is an immersion lens.

The area 19 surrounding lens 3 is fabricated of steel or other strong material to absorb the high combustive gas pressures, which can be on the order of 50,000 psi, acting upon lens 3 as a result of the firing of projectile 7. Lens 3, absorbtive support 19, and detector 5 have been designed to withstand high accelerations as well as the high combustive gas pressures. Normally, the acceleration of projectile 7 is on the order of 50,000 g.

Cover 1 must protect lens 3 from the high temperatures produced during the firing of projectile 7 and from particulates created by the combustive process. Cover 1 must be soft so that the combustive gas pressure can be delivered uniformly over surface 23, and so that cover 1 can be safely ingested by an aircraft engine in the case where the launch device is an aircraft. Cover 1 must be able to withstand the high temperatures and pressures of the breech environment without flowing or otherwise losing its integrity. Finally, cover 1 must be a poor enough heat conductor such that the heat it conducts onto surface 23 during the firing is insufficient to damage lens 3. One suitable material for cover 1 is Teflon; similar materials can be used. For certain applications, Teflon partially ablates, i.e., vaporizes, due to the high temperatures of the breech environment, and flattens somewhat from the combustive gas pressures; however, its integrity is sufficiently preserved as to enable it to accomplish its protective functions.

Figure 2:
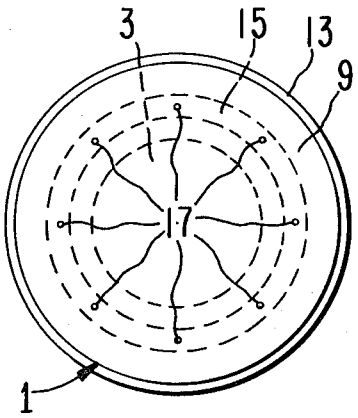
FIG. 2 is an end view of projectile 7 with cover 1 attached, taken along view lines 2—2 of FIG. 1.

Cover 1 comprises a substantially planar plate 9 which covers lens surface 23. The plane of plate 9, i.e., the plane of FIG. 2, is substantially parallel to the rear surface 21 of projectile 7. FIG. 1 shows rear surface 21 shaped to accommodate the shape of plate 9; however, surface 21 could be flat.

Cover 1 may have flanges 11 partially extending from plate 9 orthogonal to the plane of plate 9, i.e., around the periphery of projectile 7, to facilitate the temporary attachment of cover 1 to projectile 7. As illustrated, this temporary attachment may be accomplished by a securing ring 13, positioned in such a manner that it is severed by the rifling within the barrel during the firing of projectile 7 therefrom. Alternatively, cover 1 may be temporarily attached to projectile 7 by means of a bonding agent. In any case, the means of temporary attachment must be strong enough to maintain the attachment of cover 1 to projectile 7 during the loading of projectile 7 into its barrel, but not as strong as the net force of removal acting between cover 1 and projectile 7, caused by the gas pressure differentials subsequent to the latter's leaving its barrel.

Formed in plate 9, preferably in a region not directly abutting lens 3, is at least one vacated chamber 15. The figures show the use of a single toroidal chamber 15. Several small holes 17 connect chamber 15 with the rear surface of plate 9. Holes 17 permit chamber 15 to fill with combustive gases during the firing of projectile 7. When projectile 7 leaves its barrel, the pressure from these combustive gases acting on the rear surface of plate 9 drops off sharply to atmospheric. The pressure within chamber 15 quickly becomes much greater than the pressure outside the rear surface of plate 9, because the small holes 17 permit only a gradual reduction of the pressure within chamber 15. This gas pressure differential causes a net force of removal acting on cover 1 orthogonal to surface 21. This net force of removal is proportional to the cross-sectional area of chamber 15 in the plane of FIG. 2 minus the total cross-sectional area of holes 17 in this plane. Thus, the total cross-sectional area of the holes 17 should be relatively small, to facilitate the reliable and early expulsion of cover 1 from projectile 7, allowing lens 3 to view its guidance beam soon after projectile 7 leaves its barrel. Because the combustive pressure is so high, chamber 15 is rapidly filled with combustive gases during firing, even when holes 17 are very small.

The above description is included to illustrate the operation of the preferred embodiments and is not meant to limit the scope of the invention. The scope of the invention is to be limited only by the following claims. From the above discussion, many variations will be apparent to one skilled in the art that would yet be encompassed by the spirit and scope of the invention. For example, cavity 15 could directly abut rear surface 21 with no intervening portion of cover 1.

What is claimed is:

1. A soft cover for protectively covering a rearward-looking lens of a guided projectile fired from a barrel, comprising:

a substantially planar soft plate that covers an exposed rear surface of the lens; and formed within the soft plate, a vacated toroidal chamber that receives gases of combustion during the firing of the projectile from its barrel; wherein the soft plate has many small holes coupling a rear surface of the soft plate to the chamber, for admitting gases of combustion into the chamber during firing;

the shape of the chamber in the plane of the soft plate is a circular band surrounding and spaced apart from the lens;

the chamber is separated from a substantially planar rear surface of the projectile by a thin portion of soft cover generally in the shape of a circular band; and the difference between the gas pressure within the chamber and the gas pressure outside the soft plate subsequent to the projectile's leaving its barrel causes the soft cover to be removed from the lens.

2. The soft cover of claim 1 wherein the shape of the chamber in a plane orthogonal to the plane of the soft plate and dividing the projectile into halves comprises two circles.

3. The soft cover of claim 1 wherein said projectile rear surface has a recess in the shape of a half-toroid, which recess mates with the toroidal chamber overlaid by said soft cover thin portion.

4. The soft cover of claim 1 wherein the total cross-sectional area of the many small holes in the plane of the soft plate is small compared with the cross-sectional area of the chamber in this same plane.

* * * * *